US005119658A

United States Patent [19]

de Smet

[11] Patent Number: 5,119,658

[45] Date of Patent: Jun. 9, 1992

[54] METHOD AND DEVICE FOR FORMING A SHEET-METAL BLANK IN PARTICULAR IN ORDER TO MAKE A CATHODE RAY TUBE MASK, AND CATHODE RAY TUBE MASK OBTAINED ACCORDING TO THIS METHOD

[75] Inventor: Gabriel F. de Smet, Nogent sur Oise, France

[73] Assignee: Sollac, Puteaux, France

[21] Appl. No.: 628,681

[22] Filed: Dec. 17, 1990

[30] Foreign Application Priority Data

Dec. 18, 1989 [FR] France ..... 89 16725

[51] Int. Cl.[5] ..... B21D 22/10

[52] U.S. Cl. ..... 72/57; 72/348

[58] Field of Search ..... 72/57, 347, 348

[56] References Cited

U.S. PATENT DOCUMENTS 2,390,803 12/1945 Marschner ..... 72/57
2,859,719 11/1958 Kraybill ..... 72/57
3,183,696 5/1965 Way et al. .
3,234,774 2/1966 Margedant .
4,754,635 7/1988 van den Berg ..... 72/347

FOREIGN PATENT DOCUMENTS 3128251 12/1982 Fed. Rep. of Germany .
3642208 6/1987 Fed. Rep. of Germany .

*Primary Examiner*—Lowell A. Larson
*Attorney, Agent, or Firm*—Cushman, Darby & Cushman

[57] ABSTRACT

The subject of the present invention is a method for forming a sheet-metal blank (1), in particular in order to make a cathode ray tube mask, on a press, according to which the central part (1*a*) of the sheet-metal blank (1) is formed with a specified curvature under the effect of a punch (20) which deforms, in a mould (12), the upper die part (14), the load exerted on the punch (20) being distributed over the entire surface of the base (24) of the punch (20), and according to which, after the curving of the central part of the sheet-metal blank, a mechanical action is exerted on a peripheral forming member (30) so as to apply pressure to a ring (36), the ring (36) is deformed and presses against the free part (1*b*) of the sheet-metal blank (1) in order first to effect a controlled bending of the said free part, and then the said free part (1*b*) is applied, still under the action of the ring (36), along the side walls of the punch (20) in order to form the flanged edge.

15 Claims, 7 Drawing Sheets

Figure 3:
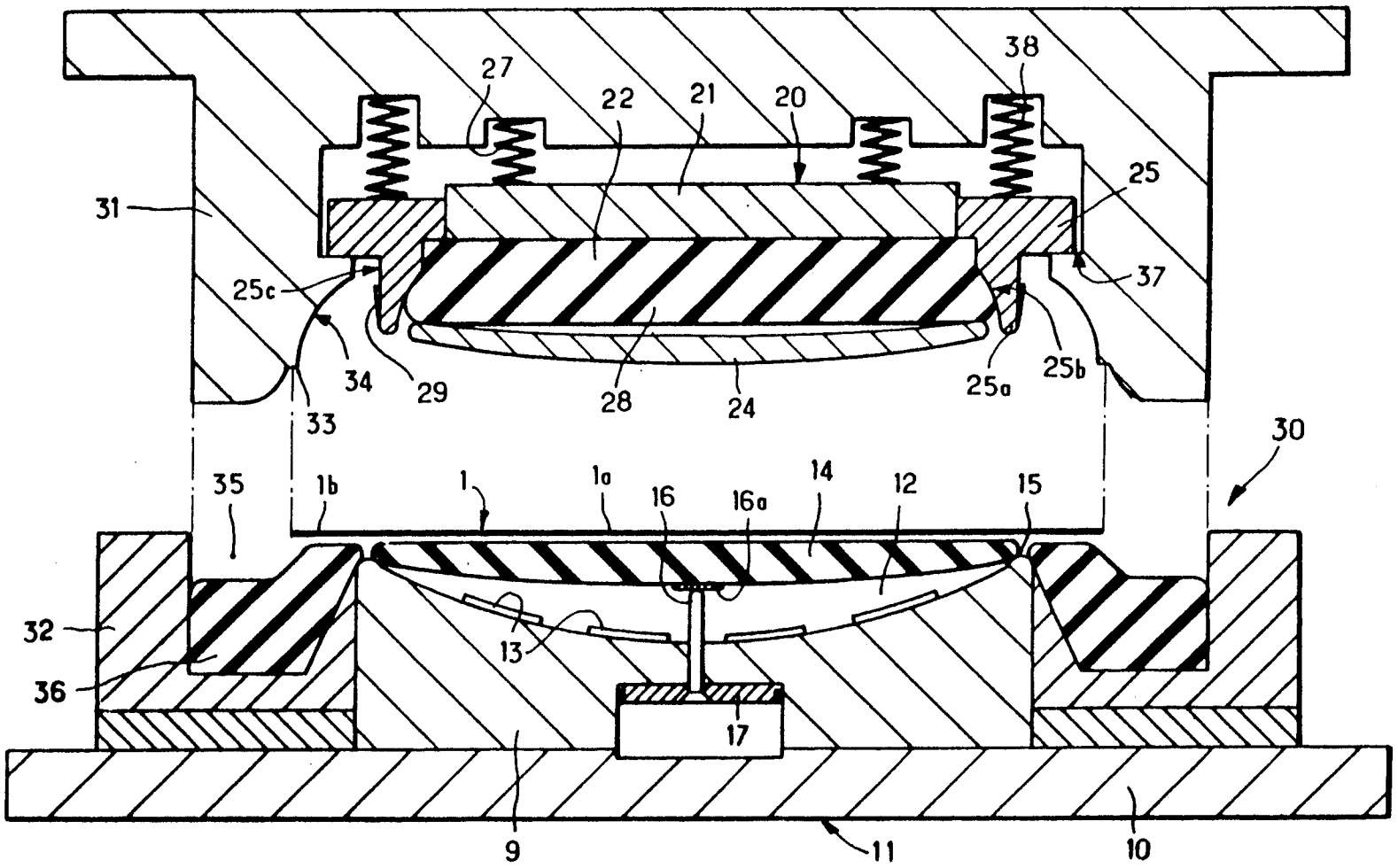

FIG. 1
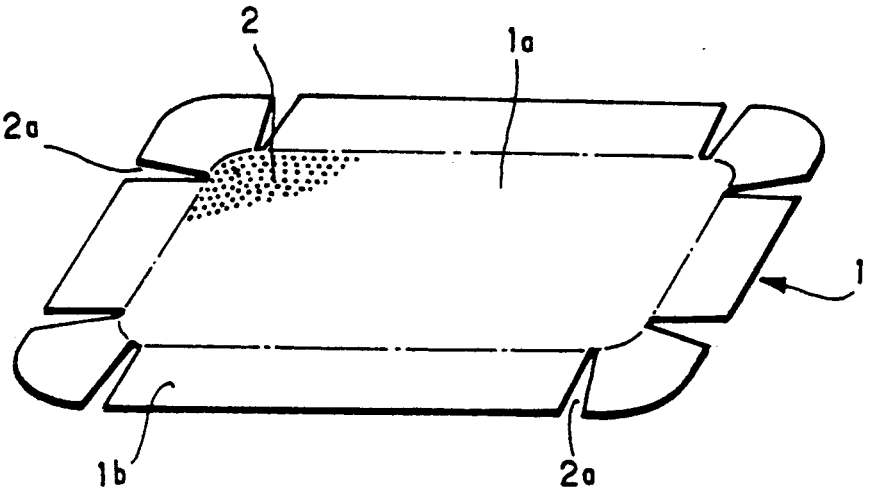
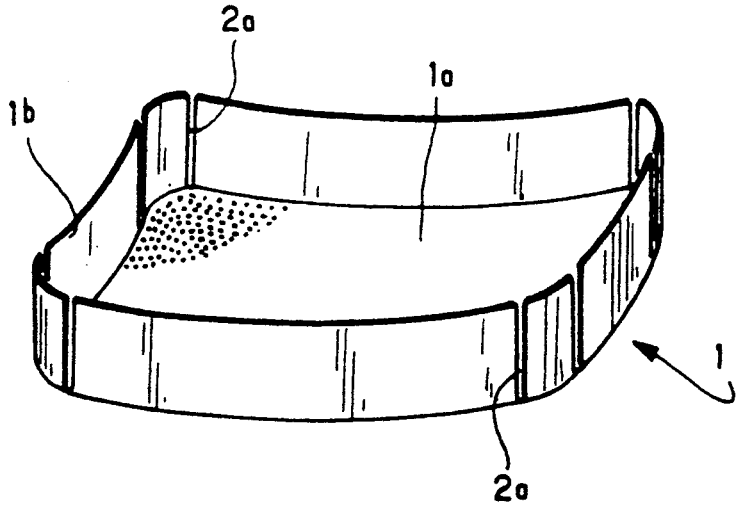
FIG. 2

METHOD AND DEVICE FOR FORMING A SHEET-METAL BLANK IN PARTICULAR IN ORDER TO MAKE A CATHODE RAY TUBE MASK, AND CATHODE RAY TUBE MASK OBTAINED ACCORDING TO THIS METHOD

The subject of the present invention is a method and a device for forming a sheet-metal blank, in particular in order to make a cathode ray tube mask.

The subject of the invention is also a cathode ray tube mask obtained according to this method.

French Patent Application no. 89 00 545 discloses a method and a device for forming a sheet-metal blank, in particular in order to make a cathode ray tube mask provided with perforations, in which method:

a sheet-metal blank is arranged between a deformable punch and a deformable die, the central part of the sheet-metal blank is clamped between the deformable punch and the deformable die, the central part of the sheet-metal blank is formed in a specified curvature by deforming the punch and the die under the action of a compressive force so as to place the centre axis of the sheet-metal blank in a given position, relative to the neutral axis of the assembly formed by the punch, the sheet-metal blank and the die, the peripheral part of the sheet-metal blank is flanged along the side walls of the punch in order to obtain the final flanged edge.

The device described in the above mentioned application comprises a die and a punch subjected to the action of a press, the die and the punch being made from a deformable material, a member for clamping the peripheral part of the sheet-metal blank, means for exerting a mechanical action on the clamping member by bringing the opposite elements of the said clamping member together, means for the relative displacement of the clamping member, and complementary means for controlling the buckling and for flanging the peripheral part of the sheet-metal blank along the side walls of the punch or the die so as to obtain the flanged edge.

This method and this device have various disadvantages.

Firstly, the action exerted by the press is applied only on a central part of the punch, and the sheet-metal blank is retained peripherally by the clamping member, which generates mechanical strains in the sheet-metal blank during the forming of the flanged edge.

Moreover, the buckling and the flanging of the peripheral part of the sheet-metal blank are caused by a deformable peripheral blade.

The devices required to make the cathode ray tube mask are consequently relatively complex and fragile.

The object of the invention is to provide a method for forming a sheet-metal blank effecting, in a single operation, the curving of the central part and the flanging or raising of the peripheral zone of the sheet-metal blank without deforming the network of perforations and at the same time avoiding the above mentioned disadvantages.

The subject of the invention is thus a method for forming a sheet-metal blank, in particular in order to make a cathode ray tube mask, on a press, the original characteristic of which lies in the fact that the base of a deformable and curved punch is flattened by clamping the central part of the sheet-metal blank placed on the horizontal plane of a likewise deformable upper die part, and the central part of the sheet-metal blank is formed in a specified curvature under the effect of a load distributed over the entire surface of a punch which deforms, in a mould, the upper die part, the sheet-metal blank and the punch, the base of the punch assuming the initial curvature again, and in that, after the curving of the central part of the sheet-metal blank:

a mechanical action is exerted on a peripheral forming member so as to apply pressure to a deformable ring made from incompressible elastic material, the ring is deformed and thus presses against the peripheral free part of the sheet-metal blank in order to effect a controlled bending of the free part and, still continuing under the action of the ring, the free part of the sheet-metal blank is applied along the side walls of the punch in order to form the flanged edge.

According to another feature of the invention, in order to apply the peripheral free part of the sheet-metal blank against the walls of the punch, in particular in order to compensate for the variation in length of the flanged edge situated between the corner zones, which variation is the result of the curvature of the central part of the sheet-metal blank, a series of ribs are formed on the flanged edge of the sheet-metal blank, the number, distribution, dimension and shape of which are determined so as to absorb the excess length.

According to yet another feature of the invention, during the bending of the peripheral free part of the sheet-metal blank by the deformable ring made from incompressible elastic material, the edge of the said peripheral free part remains pressed against the inclined faces of the forming member.

The subject of the invention is also a device for forming a sheet-metal blank, in particular in order to make a cathode ray tube mask, on a press comprising a deformable die and a punch subjected to a compressive force, the punch and the die, which are made from a deformable material, being arranged on a mould and interacting in order to form the curvature of the cathode ray tube, and means for flanging the peripheral free part of the sheet-metal blank along the side walls of the punch so as to obtain the final flanged edge, characterised in that the punch comprises a deformable base, a substantially rectangular, peripheral rigid surround, a bolster and a substantially parallepipedal, deformable pad made from incompressible elastic material contained in the surround of the punch, the said base of the punch being subjected over its entire surface to a compressive force, and the means for folding back the peripheral free part of the sheet-metal blank comprise a peripheral forming member and a deformable ring made from incompressible elastic material and the deformation of which by the peripheral forming member exerts pressure on the peripheral free part of the sheet-metal blank and controls the bending of the peripheral free part in order to apply it against the side walls of the punch.

According to other features of the invention:

the incompressible, deformable elastic materials constituting the pad and the ring are natural or synthetic composite materials, in particular polymers and polyurethanes of possibly different hardnesses, the pad and the ring are made from different materials, the lower surface of the base of the punch in contact with the surface of the sheet-metal blank has a curvature identical to that of the finished piece to be obtained, the base of the punch, and the upper die part have a substantially lenticular shape, the peripheral forming member is formed from two superposed frames, a substantially rectangular upper frame and a likewise substantially rectangular lower frame having a groove in which is inserted the deformable ring made from elastic material, the said upper frame fitting into the said lower frame, the upper frame comprises an internal shoulder for inserting and centering the sheet-metal blank, the upper frame has internal inclined faces forming a substantially pyramid-shaped bearing and slide means for the edge of the peripheral free part of the sheet-metal blank, the lower frame is integrally connected to a lower bolster supporting the die bottom, the surround of the punch has a section in the form of a T, the core of which envelopes the deformable pad of elastic material, the said surround bearing elastically on a step of the upper frame of the forming member via a peripheral pressing means, the internal surface of the core of the surround has a profile on which slides the peripheral part of the deformable pad of elastic material of the punch, the outer surface of the core of the surround has reliefs.

The subject of the invention is also a cathode ray tube mask made in accordance with the above mentioned method.

Figure 6:
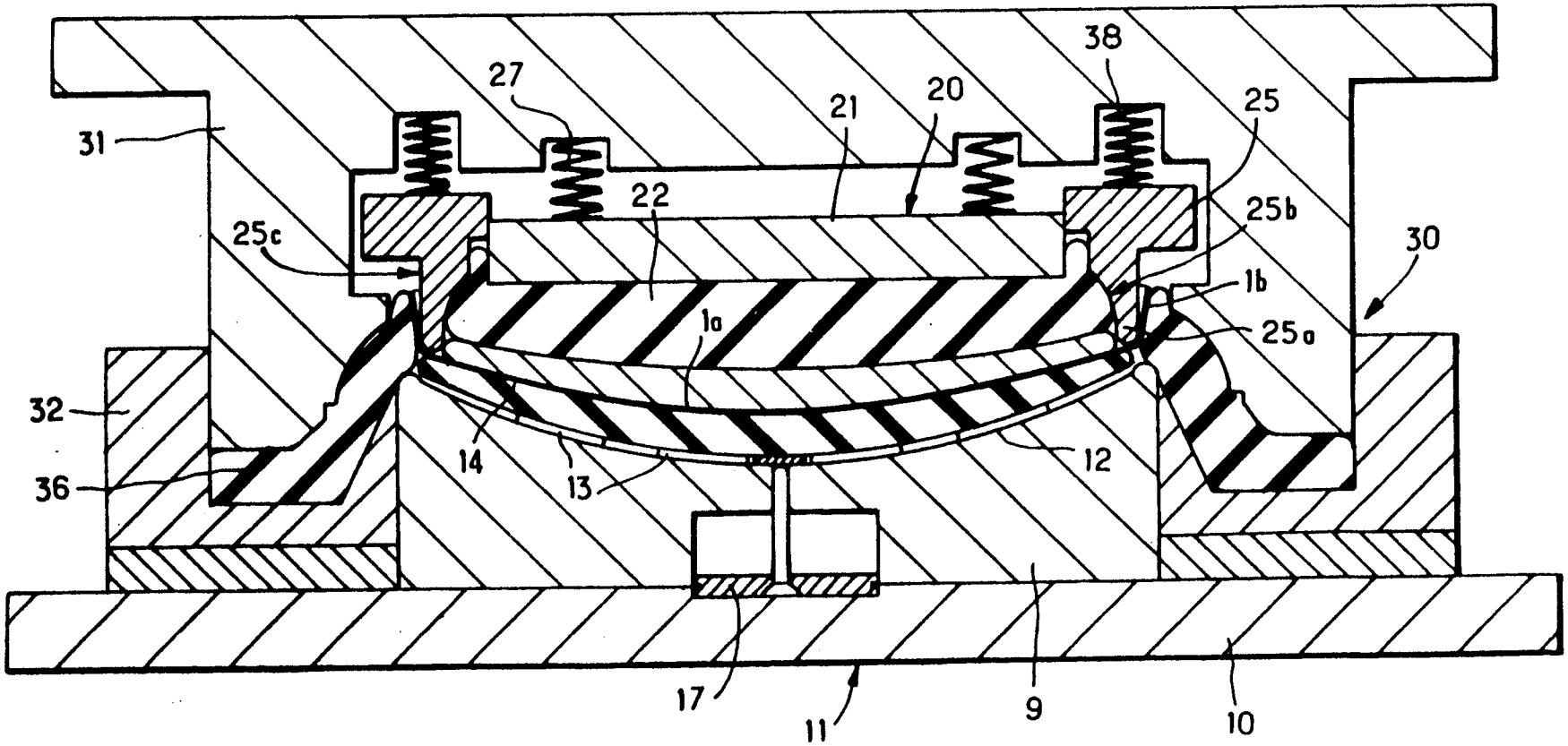
Figure 7:
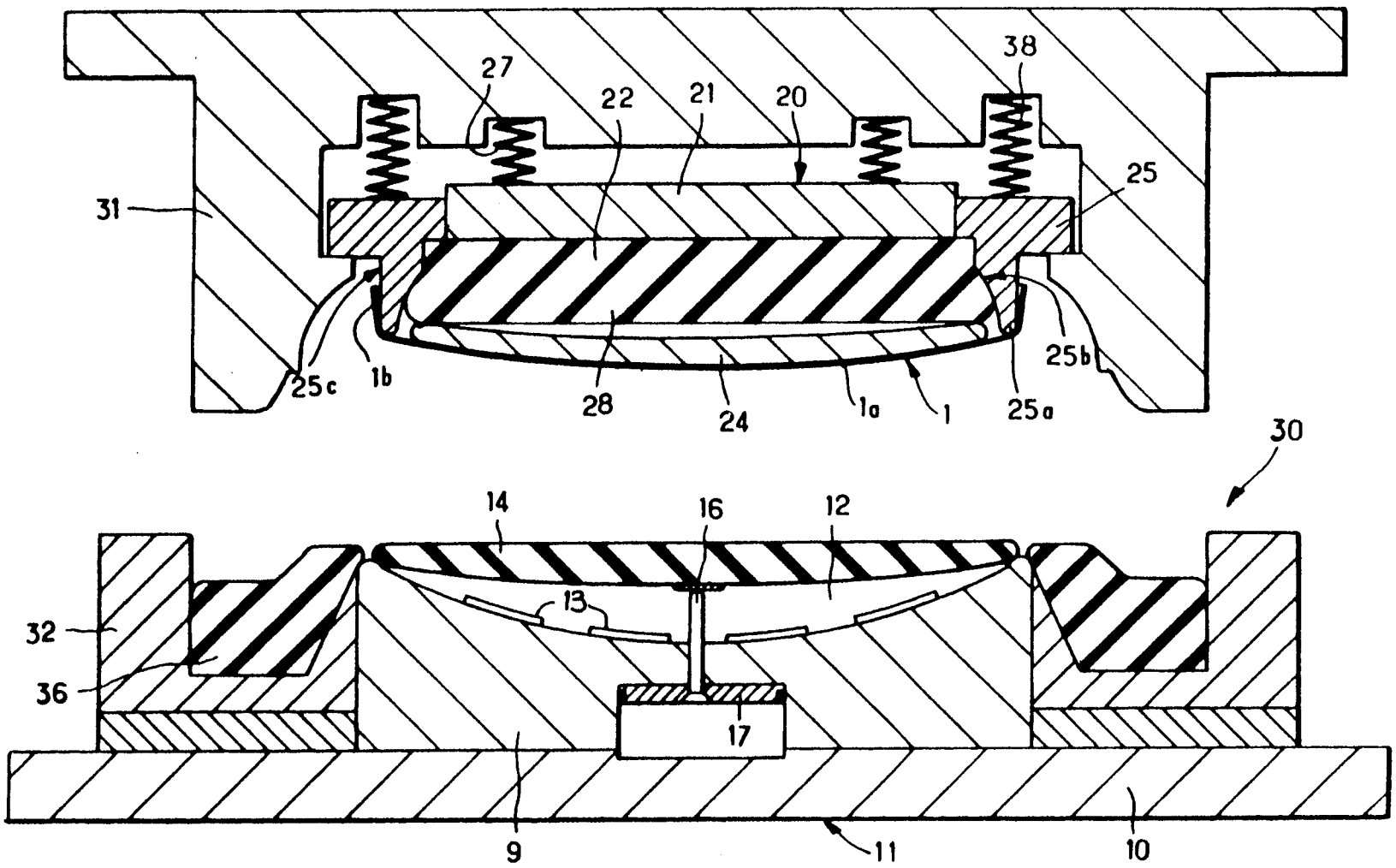
Figure 8:
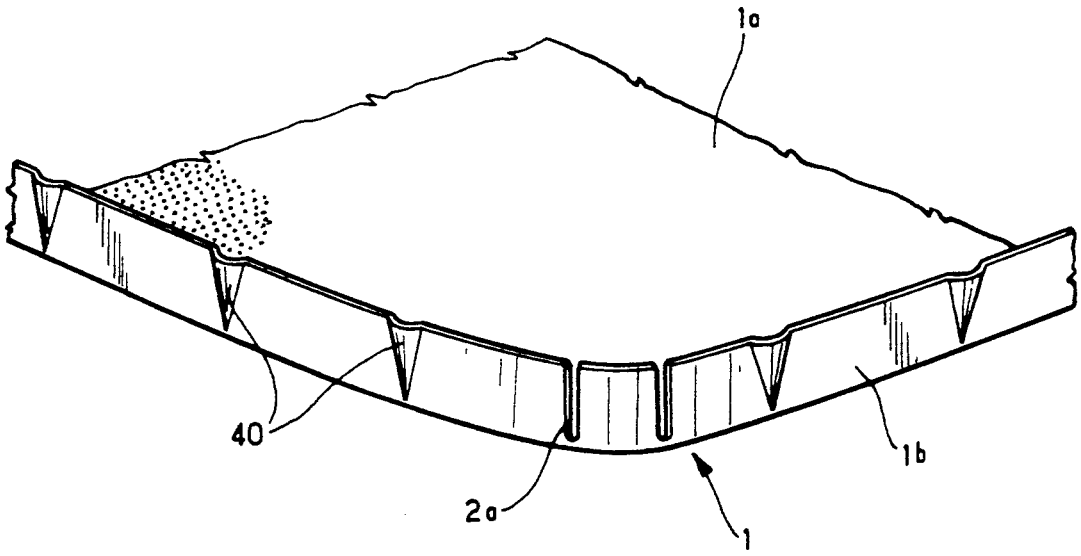

The invention will be better understood with the aid of the following description, given purely by way of example and made with reference to the attached drawings, in which:

FIG. 1 is a perspective view of a sheet-metal blank from which is made a cathode ray tube mask, FIG. 2 is a perspective view of a formed mask, FIG. 3 is a view in section of an embodiment of the device according to the invention, FIGS. 4 to 7 are views in section showing the successive stages of forming a mask, FIG. 8 is a diagrammatic perspective view of part of a mask, showing the ribs formed on the flanged edge of the said mask.

FIG. 1 shows a sheet-metal blank 1 of very small thickness from which is made a cathode ray tube mask. This sheet-metal blank 1 comprises a central part 1*a* provided with a network 2 of perforations, a peripheral part 1*b* comprising, in the corner zones, notches 2*a* in order to facilitate the flanging of the edge and thus to eliminate the excess material resulting from the said flanging of the edge.

The mask made after forming has a central curved part 1*a* and a peripheral raised part 1*b*, termed flanged edge, as can be seen in FIG. 2, making it possible to preserve the shape of the curvature.

The forming device shown in FIG. 3 for making, for example, a cathode ray tube mask comprises a die 11 composed of a plane lower bolster 10 on which rests a die bottom 9. This die bottom 9 has, in its upper part, a form mould 12, on the surface of which is distributed a series of calibrated wedges 13.

Above the die bottom 9, the forming device comprises a deformable upper die part 14 made from elastic material which rests by way of its peripheral part on the edge 15 of the form mould 12.

The lower surface of the upper die part 14 is in contact, via a bearing point 16*a*, with a rod 16 connected, for example, to a piston 17 of a jack.

The forming device also consists of a punch 20 comprising a punch bolster 21, a deformable pad 22 made from incompressible elastic material, a deformable base 24 arranged beneath the pad 22, and a substantially rectangular, peripheral rigid surround 25 containing the said pad 22.

The base 24 of the punch 20 is subjected to pressure via the deformable pad 22 which is itself subjected to pressure by pressing means 27 via the punch bolster 21.

The upper surface of the upper die part 14 is plane, whereas the surface in contact with the sheet-metal blank 1 of the base 24 of the punch 20 is curved in a curvature identical to the finished part to be obtained.

Moreover, the deformable upper die part 14 and the base 24 of the punch 20 have, for example, a lenticular shape which, given a specified load distributed over the surface 28 of the base 24 of the punch 20 and the laws of mechanical deformation for the materials of which they consist, makes it possible to obtain a curvature of the sheet-metal blank 1 without damaging the network 2 of perforations constituting the screen of the cathode ray tube mask.

The surround 25 of the punch 20 is a rectangular frame which has a section in the shape of a T, the core 25*a* of which envelopes the deformable pad 22.

The core 25*a* has, on its inner face, a profile 25*b* in order to act on the load exerted and on which slides the peripheral part of the deformable pad 22, and the outer face 25*c* of the said core 25*a* forms the side wall of the punch 20.

This outer face 25*c* can have reliefs 29, for example of a substantially conical shape.

The forming device also comprises, around the punch 20 and the upper die part 14, a peripheral forming member designated as a whole by the reference 30 (FIG. 3).

The forming member 30 consists of two superposed frames (31, 32), a rectangular upper frame 31 comprising, on its inner wall, a shoulder 33 for inserting and centering the sheet-metal blank 1 and inclined faces 34 forming a substantially pyramid-shaped bearing and slide means, for the edge of the peripheral free part 1*b* of the sheet-metal blank 1, and a lower frame 32 comprising a groove 35 provided opposite the upper frame 31 and into which is inserted a deformable ring 36 made from incompressible elastic material in order to form the peripheral free part 1*b* of the sheet-metal blank 1, as will be seen subsequently.

The upper frame 31 has an internal step 37 on which the surround 25 bears elastically via a peripheral pressing means 38 formed, for example, by springs.

The lower frame 32 can be connected to the die bottom 9 and to the lower bolster 10 in order to form a unit.

Incompressible, elastic deformable materials constituting the pad 22 and the ring 36 can be natural or synthetic composite materials, and in particular polymers or polyurethanes of hardnesses which may differ; the materials constituting the pad and the ring not necessarily being the same.

The pad 22 and the ring 36 can be made from different materials.

In the embodiment illustrated, the deformable ring 36 has been shown beneath the sheet-metal blank 1, which results in the edge being raised, but it is clear that it is possible to design a symmetrical version in which the edge is folded back with the aid of a deformable ring 36 arranged above the blank and to which a descending movement is imparted.

The forming of the sheet-metal blank 1 is effected in the following manner.

Firstly, the sheet-metal blank 1 is laid on the upper die part 14 in such a way that a small width of its peripheral edge covers the upper part of the ring 36.

Figure 4:
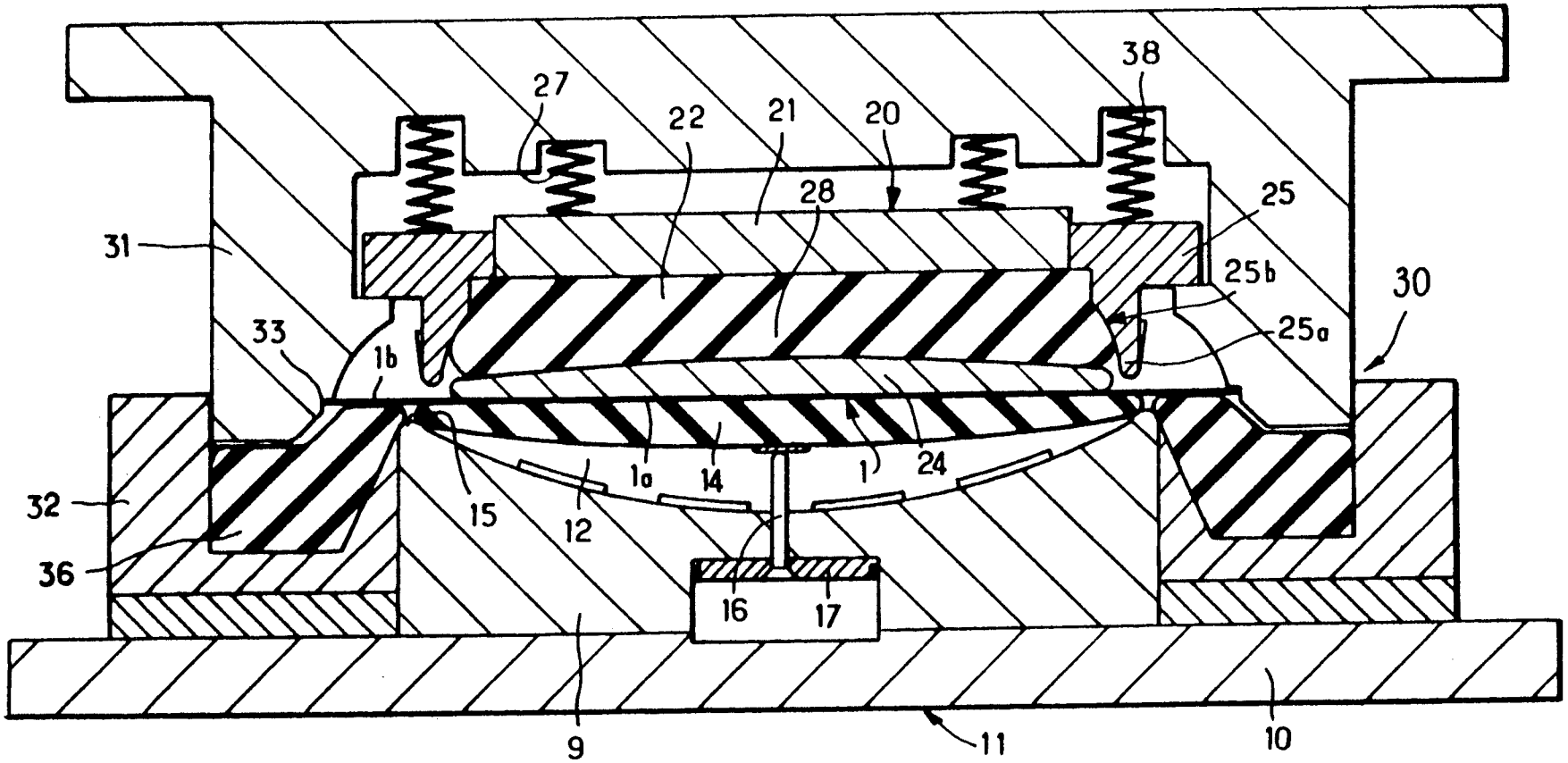
Figure 5:
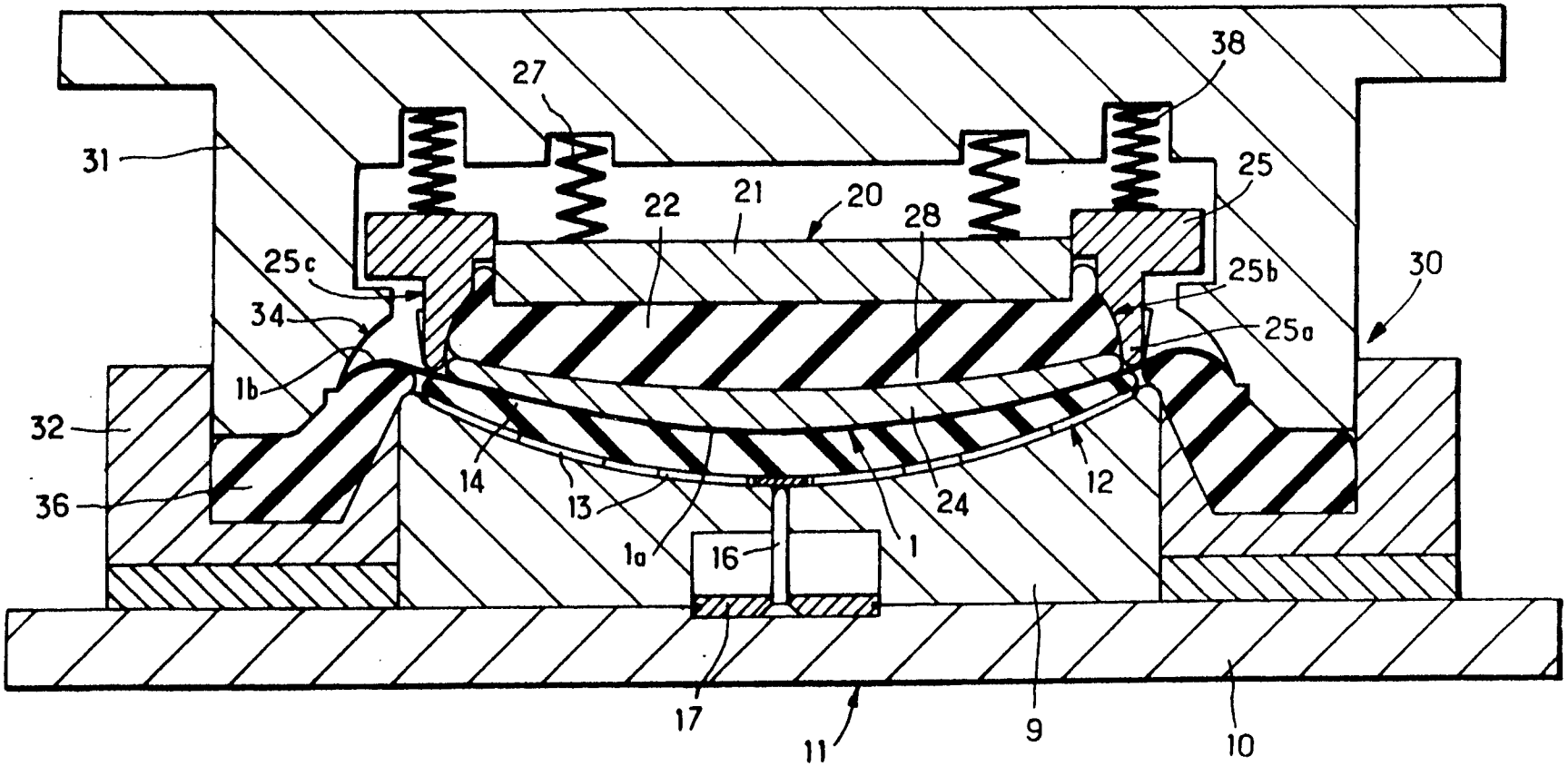

Under the action of a slide, not shown, of the press which acts on the upper frame 31, the upper part of the device is lowered so as to centre and hold the peripheral part of the sheet-metal blank 1 bearing in the shoulder 33 of the upper frame 31 of the forming member 30 (FIG. 4).

During this operation, the retractable rod 16 is held in the upper position by the piston 17, which prevents any deformation of the upper die part 14.

The base 24 of the punch 20 is thus deformed (FIG. 4), such that the central part 1*a* of the sheet-metal blank 1 is clamped in a horizontal plane between the said base 24 and the upper die part 14.

The retractable rod 16 is then unlocked and, still under the action of the slide of the press, and via the deformable pad 22, in a curvature determined by the defined characteristics of the base 24 of the punch 20, of the deformable upper die part 14, of the mould 12 of the die bottom 9 equipped with the calibrated wedges 13, the central part 1*a* of the sheet-metal blank 1 is formed by deforming the punch base 24, sheet-metal blank 1*a* and upper die part 14 assembly (FIGS. 5 and 6), the centre axis of the sheet-metal blank 1 being placed in a specified position relative to the neutral axis of the said assembly, the base 24 of the punch 20 then returning to its initial curved shape.

The load exerted by the punch 20 is distributed uniformly over the entire surface of the base 24 of the punch 20 via the pad 22.

By modifying the position of the sheet-metal blank 1 relative to the neutral axis of the punch base 24, the central part 1*a* of the sheet-metal blank and upper die part 14 assembly, it is possible to generate, at least in localised zones of the sheet-metal blank, internal compressive or tensile stresses as a function of the subsequent use of the formed part. Furthermore, the deformation is exerted relative to the centre axis of the metal from which the sheet-metal blank 1 is made in order to have a homogeneous deformation and so as not to modify the geometry of the network 2 of perforations of the central part 1*a* of the sheet-metal blank 1.

Lastly, still under the action of the slide of the press, after the curving of the central part 1*a*, the controlled bending of the peripheral free part 1*b* of the sheet-metal blank 1 situated between the punch 20 and the peripheral forming member 30 is carried out.

In order to do this, still under the action of the press, a mechanical action is exerted on the peripheral forming member 30 which brings together the upper frame 31 and lower frame 32 of the said peripheral forming member in order to effect, on the free part 1*b* of the sheet-metal blank 1, a bending oriented and controlled so as to minimise, or even cancel out, the forces applied to the periphery of the punch 20 so as not to deform the network of perforations.

To this end, the upper frame 31 fits inside the lower frame 32 and compresses the deformable ring 36.

This ring 36 is deformed and inserted into the space situated between the internal inclined face 34 of the upper frame 31, and the external face 25*c* of the surround 25 of the punch 20, which imparts a rising movement to the peripheral free part 1*b* of the sheet-metal blank 1.

During this rising movement, the free part 1*b* of the sheet-metal blank 1 is displaced (FIG. 5) in such a way in that its edge slides on the inclined faces 34 of the upper frame 31 and is applied along the external face 25*c* of the punch 20 (FIG. 6).

The upper part of the device is then lifted again such that the ring 36, the pad 22, the base 24 of the punch, and the upper die part 14 assume their initial positions again, as shown in FIG. 7.

After the device has been opened, all that remains is for the cathode ray tube mask thus formed to be withdrawn.

During the folding back of the peripheral free part 1*b* of the sheet-metal blank 1 on the external face 25*c* of the surround 25, by the deformation of the ring 36, the reliefs 29 provided on the said external face 25*c* form, between the corner zones of the flanged edge 1*b* of the sheet-metal blank 1, a series of ribs 40, for example of conical shape (FIG. 8).

The number, the distribution, the dimension and the shape of the ribs 40 formed by the reliefs 29 are determined so as to absorb the excess length corresponding to the variation in length of the flanged edge, which variation is generated during its production.

I claim:

1. Method for forming a sheet-metal blank on a press to make a cathode ray tube mask which comprises:

arranging a sheet metal blank, having a central part and a peripheral free part, between a punch and a die, said peripheral free part including an edge, said die comprising a deformable upper die part, a die bottom, and a forming mould, said punch including a deformable base, and side walls, said base, said upper die part and said sheet metal blank each having a neutral axis;

clamping said central part, having a center axis, in a horizontal plane between said base and said upper die part, thereby flattening said base;

forming said central part to a specified curvature, said curvature determined by the characteristics of said base, said upper die part and said mould, said forming occurring by deforming in said mould, said base, said sheet-metal blank and said upper die part under the action of a load exerted by said punch, said load distributed uniformly over the entire surface of said base so as to place said center axis in a given position relative to said neutral axis of said base, said sheet metal blank and said upper die part, said base then returning to its initial curved shape;

bending said peripheral free part to obtain a flanged edge by utilizing a forming member disposed about the periphery of said die and said punch, said forming member including an upper frame disposed about the periphery of said punch, said upper frame having inclined faces, and a lower frame disposed about the periphery of said die, said lower frame includes a groove disposed opposite said upper frame, wherein a ring is disposed, said forming member being acted upon by a mechanical action so as to bring together said upper frame and said lower frame thereby deforming said ring, said ring thus presses against said peripheral free part to effect controlled bending of said peripheral free part, said edge of said peripheral free part, under the action of said ring, being applied along said side walls of said punch to form said flanged edge.

2. Method according to claim 1, which further comprises forming a plurality of ribs on said flanged edge of said sheet-metal blank, the distribution, number, dimension and shape of said rib so determined so as to absorb excess length corresponding to a variation in length of said flanged edge, said variation due to curvature of said central part of said sheet-metal blank.

3. Method according to claim 1 wherein said edge of said peripheral free part remains pressed against said inclined faces of said upper frame during the bending of said peripheral free part.

4. Device for forming a sheet-metal blank on a press to make a cathode ray tube mask comprising:

a die, including an upper die part made from deformable material, a die bottom including a mould form, said upper die part resting on said die bottom, and a punch disposed above said die, having side walls, said punch including:

a first means for pressing, a second means for pressing, a punch bolster affixed to said first means for pressing, a deformable pad made from incompressible elastic material, having an outer periphery, a surround which envelopes the periphery of said deformable pad, a base having an upper and lower surface, made from deformable material disposed beneath said deformable pad, said base being subjected over its entire surface to a compressive force transmitted from said first pressing means through said punch bolster and said deformable pad, and a means for flanging edges of the sheet-metal blank, said means for comprising a forming member, said forming member includes a substantially rectangular upper frame disposed about the periphery of said punch, and a substantially rectangular lower frame disposed about the periphery of said die, said lower frame including a groove disposed opposite said upper frame wherein a deformable ring made from elastic material is disposed, said upper frame including an internal step on which said surround bears elastically via said second means for pressing, said upper frame configured to fit into said groove of said lower frame, said upper die part and said punch being subjected to a compressive force to interact with said mold to form a curvature in the sheet-metal blank, said means for flanging being exposed to mechanical action permitting said upper frame to be fitted into said groove of said lower frame so as to deform said deformable ring permitting the edges of the sheet-metal blank to be forced against said side walls of said punch.

5. Device as claimed in claim 4 wherein the deformable material of said deformable pad and said deformable ring is natural or synthetic composite materials including polymers and polyurethanes of different hardness.

6. Device as claimed in claim 4 wherein said deformable pad and said deformable ring are made from different materials.

7. Device as claimed in claim 4, wherein said lower surface of said base has a curvature identical to that of the finished piece to be obtained.

8. Device as claimed in claim 4, wherein said base and said upper die part have a substantially lenticular shape.

9. Device as claimed in claim 4 wherein said upper frame further comprises an internal shoulder for inserting and centering the edge of the sheet-metal blank.

10. Device as claimed in claim 4 wherein said upper frame further comprises internal inclined faces forming a substantially pyramid-shaped bearing and slide means for the edge of the sheet-metal blank, while being formed by said deformable ring.

11. Device as claimed in claim 4, wherein said lower frame further comprises a lower bolster affixed to said die bottom for support.

12. Device as claimed in claim 4 wherein said surround further comprises a section in the form of a T, having a core which envelopes said deformable pad, said core having an inner and outer surfaces.

13. Device as claimed in claim 12, wherein said inner face of said core has a profile permitting said outer periphery of said deformable pad to slide thereon.

14. Device as claimed in claim 12, wherein said outer face of said core further comprises reliefs.

15. Device as claimed in claim 12 wherein said mould further comprises a series of calibrated wedges disposed on said die bottom.

* * * * *